United States Patent [19]

Stearns

[11] 4,306,882

[45] Dec. 22, 1981

[54] CARBON SLURRY FUELS

[75] Inventor: Richard S. Stearns, West Chester, Pa.

[73] Assignee: Suntech, Inc., Philadelphia, Pa.

[21] Appl. No.: 237,225

[22] Filed: Feb. 23, 1981

[51] Int. Cl.[3] ..... C10L 1/32

[52] U.S. Cl. ..... 44/51; 44/63; 44/67; 44/76

[58] Field of Search ..... 44/51, 63, 67, 76

[56] References Cited

U.S. PATENT DOCUMENTS

| | | | |
|---|---|---|---|
| 1,390,231 | 9/1921 | Bates | 44/51 |
| 2,231,513 | 2/1941 | Stillman | 44/51 |
| 2,590,733 | 3/1952 | Stillman | 44/51 |
| 3,764,547 | 10/1973 | Schlinger et al. | 44/51 |

OTHER PUBLICATIONS

Chemical Week, Oct. 29, 1980, p. 79.

D. J. Jeffrey et al., (AICHE) Journal; vol. 22, No. 3, May 1976, p. 417.

*Primary Examiner*—Jacqueline V. Howard

*Attorney, Agent, or Firm*—J. Edward Hess; Donald R. Johnson; Paul Lipsitz

[57] ABSTRACT

A liquid composition suitable as a high performance fuel and having improved rheological and stability properties comprising a liquid hydrocarbon having carbon particles dispersed therein of at least two disparate particle sizes, one of said carbon particles having an average particle diameter of from about 300 to about 350 mu and the other particle having an average particle diameter of about 60 to about 80 mu.

10 Claims, 2 Drawing Figures

Figure 2:
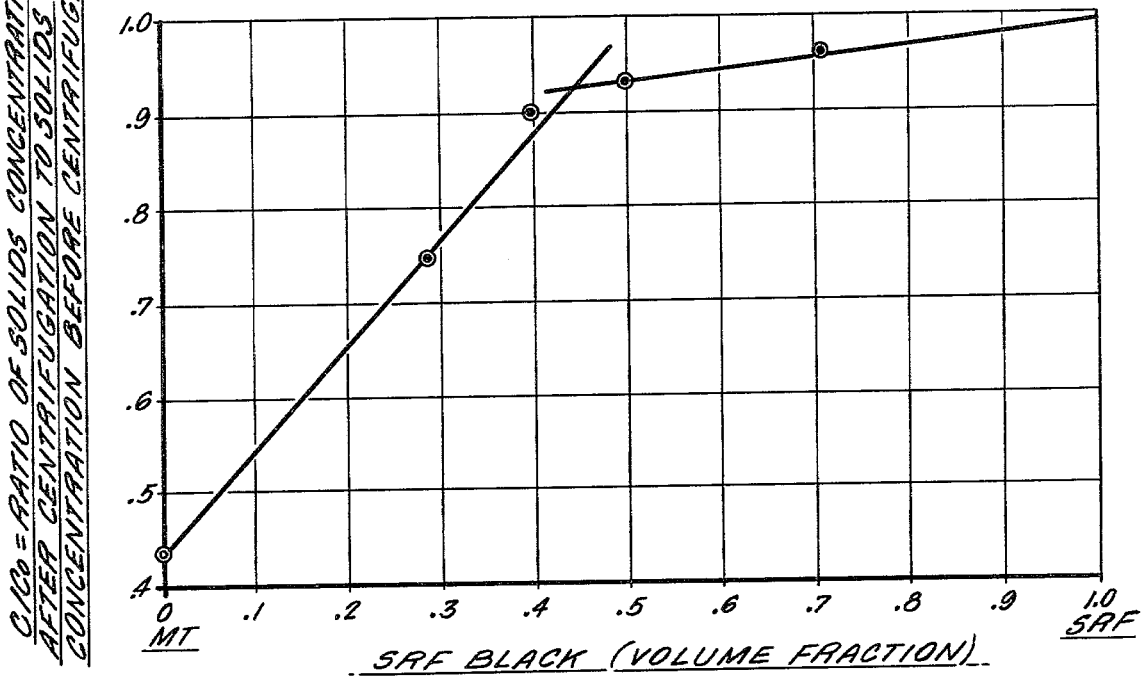

STABILITY OF MT AND SRF CARBON BLACKS IN 60:40 (VOLUME) MIXTURE OF RJ-5 AND JP-10 CENTRIFUGED AT 1000 G'S

VISCOSITY OF MT AND SRF IN RJ-5/JP-10 (60/40)

CARBON SLURRY FUELS

It is known that the volumetric net heat of combustion of liquid fuels can be increased by adding to the liquid finely divided solids such as carbon which have densities substantially greater than that of the liquids themselves and are also capable of being consumed via an oxidation process involving the formation of gases. In making such slurry fuels it is desirable to obtain a liquid product which is pumpable, i.e., it should exhibit a low viscosity, at least under shear, and will have other rheological properties that will enable it to be atomized in a nozzle and burned, say in a ramjet or turbine engine. A particle of high density is important in order to increase the volumetric heat of combustion, or conversely, for a given volumetric heat of combustion a high density particle enables a lower particle concentration to be used resulting in better rheological properties (e.g. a more fluid dispersion). Also, the dispersion of particles in the fuel must also be stable and not settle out over a period of time.

U.S. Pat. No. 2,754,267 discusses this problem to some extent and discloses suspensions of carbon in a fuel oil used for increasing flame radiation where the carbon-containing fuel oil is injected into steel mill furnaces. In the disclosure of this patent carbon blacks are used with a large exposed surface area having monomolecular layers of certain polymers on the surface, the carbon particles being preferably anisometric (i.e., not spherical) and of a particle size diameter of the shortest dimension of less than about 1 micron, preferably 0.02 to 0.8 micron.

It is also known that spherically shaped carbon particles can be dispersed in jet fuels (Final Report; Ramjet Fuels Analysis Supplement, Contract No. Y6E140, Ashland Chemical Company, Research and Development Division, Process Development Section, L. J. Frainier and P. M. Colling). However, as pointed out in this report, a concentration of carbon particles above 40% by weight could not be achieved and such concentrations are below that required to give an effective carbon-slurry fuel.

What is required for an effective carbon-slurry fuel is a liquid slurry which is highly stable, has suitable viscosity characteristics (e.g. will flow properly during use), and which has a high carbon content so that the formulation can yield high thermal energy. Thus, the carbon slurry fuel composition must have properties that are unique with respect to its rheological properties and stability and, therefore, which make it a highly desirable fuel for use in high performance gas turbine engines such as those utilized by manned aircraft, military missiles, or various types of self propelled vehicles such as trucks, military tanks, etc. where there is a premium placed on the heat content of the fuel in terms of BTU/gallon, i.e., volume limited applications. These fuel compositions must be pumpable, which puts constraints on the viscosity, while at the same time exhibiting a high degree of stability with respect to the settling of the dispersed particles over a long time period. In addition the net volumetric heat of combustion expressed as BTU/gallon must be kept as high as possible which requires as high a dispersed carbon content as can be tolerated in the hydrocarbon fuel and still maintain a flowable dispersion under the conditions of shear encountered in fuel transport from the vehicle storage vessel to the combustion chamber. In general, the required heat of combustion for such fuels must be at least about 170,000 BTU per gallon of slurry, preferably equal to or greater than 180,000 BTU/gal.

The addition of appropriate amounts of a medium thermal black to a fuel will give a composition of high energy, but such a composition is unstable; that is, the particulates will settle out. The use of deflocculants help reduce this instability, but to overcome it satisfactorily so much deflocculant is needed that the heat of combustion is significantly reduced. A semi-reinforcing furnace black may also be used in a hydrocarbon to produce a high energy fuel, but in this instance so much is required for about 180,000 BTU per gallon of slurry that the fuel composition becomes very viscous or even gelled and cannot be pumped to the engine.

In accord with this invention a novel slurry fuel composition of high particulate concentration and of satisfactory stability and rheological properties is provided, comprising a liquid hydrocarbon having dispersed therein at least about 50% by weight of the hydrocarbon of carbon particles comprising two disparate particle sizes and wherein one carbon particle has an average particle diameter of from about 300 to about 350 mu and the second carbon particle has an average particle diameter of about 60 mu to about 100 mu. A suitable carbon particle having an average particle diameter of from about 300 to about 350 mu is available commercially as medium thermal (MT) black. A semi-reinforcing furnace black has an average particle size of from about 60 mu to about 100 mu and is quite suitable as the smaller carbon particle for the invention.

The liquid hydrocarbons employed to make the slurry fuels will be high density fuels having a density of at least about 0.9 and will be conventional jet fuel types such as methylcyclohexane, JP-4, JP-5, JP-9, JP-10, RJ-4, RJ-5, RJ-6 and the like or their mixtures. The technology for making slurry fuels from these materials is well known and will be employed in making the fuels of this invention. In one embodiment of the invention a blend of RJ-5 and JP-10 will be used preferably in a volumetric ratio of about 60:40.

The carbon slurry formulation will contain appropriate additives in stabilizing amounts to aid in the dispersing and stabilizing of the suspension. Any one or more of a number of commercial surfactants can be utilized as, for example, succinnimide types, barium sulfonate, calcium sulfonate, imide type pigment dispersants, and the like. For long-term stability, it may be desirable to add an aluminum soap to the dispersion. A preferred agent to impart stability to the suspension is an oligomeric succinnimide containing about 2.3% nitrogen (sold by Edwin Cooper as Hitec E-645 Deflocculant) and is added at a level of 5% of the carbon content of the slurry.

The two blacks of different particle sizes will be used in a weight ratio of from about 40:60 to about 60:40, preferably about 50:50. As indicated, both the medium thermal black (MTB) and the semi-reinforcing furnace black (SRB) are well known products readily available commercially and require no special treatment before use in the formulation. In making the carbon slurry fuel of the invention all that is required is to thoroughly mix the ingredients into the hydrocarbon liquid with a high speed mixer or other device to ensure that a well dispersed product is obtained.

The concentration of the carbon in the fuel will be at least about 40% in a high density fuel such as RJ-6 (density=1.02) and up to about 65% in a high energy fuel having a density of about 0.93 (JP-10). It will be understood, that appropriate milling procedures, use of dispersants and other conventional techniques will be used in preparing the dispersions. A concentration much above 65% by weight, although achievable, will generally be too viscous to be used as a fluid fuel composition.

The fuel composition of the invention will have a stability of at least about 0.9 which is the ratio representing the concentration of black in the upper one ml. in a standard 15 ml. centrifuge tube after centrifuging the composition for eight hours at 2285 RPM (about 1000 G's), divided by the black concentration before centrifugation. Such stability will be obtained by using semi-reinforcing furnace black in an amount of about 45 to about 60% of the total black (MT black and SRF black) used. Above about 60% SR black the composition is too viscous for use in jet engines and the like. Reference is made to FIG. 2 where these limiting values are evident. Also of significance from the figure is the sudden change in slope of the curve at about 45% SRF black. This clearly illustrates the unexpected improvement in stability that occurs at an SRF black content of about 45%.

The fuel composition of the invention, when used as fuel for a missile system, will be optimally characterized by a pour point of −65° F. and a viscosity at ambient conditions of less than 1000 cps. The slurry fuel is readily pumped and atomized, and will be stable over a temperature range of from about −65° to about 250° F.

In order to further illustrate the invention the following example is given:

EXAMPLE 1

To a mixture of RJ-5 and JP-10 in a volumetric ratio of 60:40 there was added various amounts of a medium thermal black (ASTM designation N-990) and a semi-reinforcing furnace black (N-754) and a deflocculant (Hitec E-645) at a concentration of 5% by weight of the carbon black. A high speed mixer (15,000 to 20,000 RPM) was used to mix the ingredients for one hour in a two liter stainless steel flask with cooling provided to maintain the temperature at ambient conditions.

The finished slurry was subjected to measurements of viscosity and stability.

Viscosity was measured on a Haake rotating cylinder viscometer at an rpm where the slurry viscosity was substantially constant with shear rate, i.e., Bingham or Newtonian in behavior.

Stability was measured by centrifuging 15 ml. of the slurries for eight hours at 2285 rpm (ca 1000 G's) in a laboratory bench top centrifuge and sampling the top 1 ml.

Figure 1:
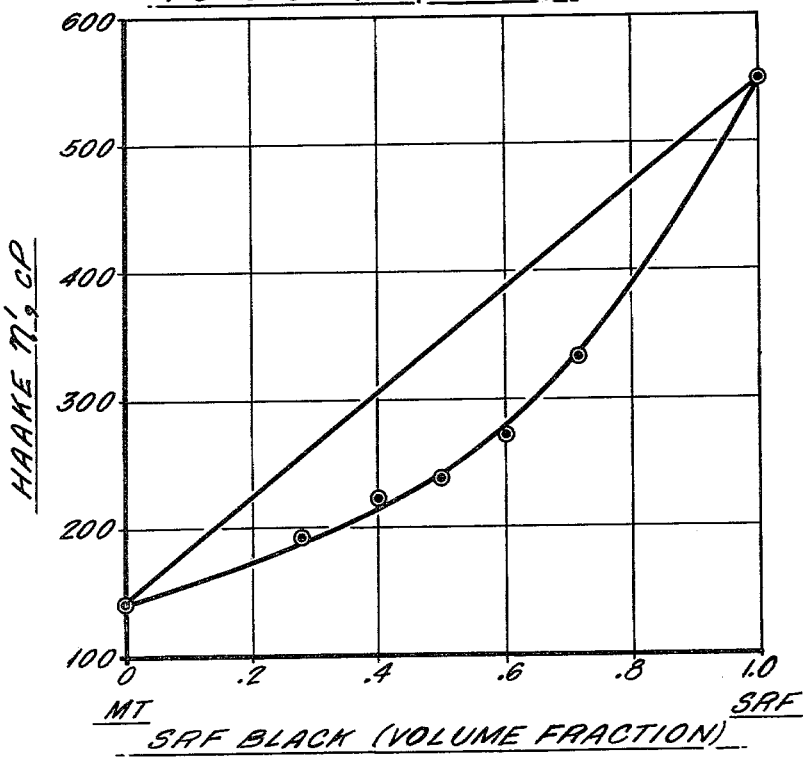

The variation of viscosity with carbon composition is shown in FIG. 1 and the stability in FIG. 2. Note in FIG. 1 that the blends of the MT and SR black deviate from linearity with the viscosity of the blends being less than would be expected from linear blending behavior while in FIG. 2 the stability of the mixtures shows a distinct increase beginning at about a 45 volume percent SRF black.

The carbon dispersion is fluid at −65° F. and has a Brookfield viscosity of 20,000 to 30,000 cps whereas SRF black alone dispersed in a 60:40 RJ-5/JP-10 mixture is solid by −40° F.

Table I is a summary comparison of various 180,000 BTU/Gal. fuel compositions prepared containing MT and SRF blacks from a 60:40 by volume mixture of RJ-5 and JP-10 and JP-10 alone and indicates the superiority of mixtures of MT and SRF blacks in viscosity and stability in accord with the invention.

TABLE I

PROPERTIES OF SLURRIES WITH HEATS OF COMBUSTION OF 180,000 BTU/GAL FUEL COMPOSITION

| BLACK | | FUEL | | WT % | % | $N_{60}CP$ | | STABILITY* |
|---|---|---|---|---|---|---|---|---|
| MT | SRF | JP-10 | RJ-5 | CARBON | GELLANT+ | 68° F. | −65° F. | $C/C_o$ |
| 100 | — | 100 | — | 64 | — | 85 | 1,000 | Not Stable |
| 100 | — | 100 | — | 63 | 0.5 | 600 | 15,000 | 0.67 |
| 50 | 50 | 100 | — | 64.5 | — | 1000 | 15,000 | 0.90 |
| 100 | — | 40 | 60 | 56 | — | 105 | 8,000 | 0.35 |
| — | 100 | 40 | 60 | 56 | — | 1600 | SOLID | 0.94 |
| 50 | 50 | 40 | 60 | 56 | — | 360 | 20,000 | 0.96 |

*C = Black concentration after centrifugation.
$C_o$ = Black concentration before centrifugation.
+Gellant was a hydrocarbon polymer used to stabilize composition.

I claim:

1. A liquid composition suitable as a high density, high performance fuel and having improved rheological and stability properties comprising a liquid hydrocarbon fuel having carbon particles dispersed therein of at least two disparate particle sizes, one of said carbon particles having an average particle diameter of from about 300 to about 350 mu and the other particle having an average particle diameter of about 60 to about 100 mu, said carbon particles of said different sizes being present in a weight ratio of from about 40:60 to 60:40 and the total amount of said carbon particles in said fuel being from about 40% to about 65% by weight.

2. The composition of claim 1 wherein the carbon particles comprise a medium thermal (MT) black and a semi-reinforcing furnace (SRF) black.

3. The composition of claim 2 wherein the fuel is JP-10.

4. The composition of claim 2 wherein the fuel is a 40:60 by volume mixture of JP-10 and RJ-5.

5. The composition of claim 2 wherein the fuel is a 40:60 by volume mixture of JP-10 and RJ-5, the weight ratio of MT black and SRF black is 50:50, and the total amount of carbon in the fuel is about 56% by weight.

6. The composition of claim 3 wherein the weight ratio of MT black and SRF black is 50:50 and the total amount of carbon in the fuel is about 65% by weight.

7. A liquid composition suitable as a high performance fuel and having improved rheological and stability properties comprising a liquid hydrocarbon fuel having a density of at least about 0.9 and having carbon particles dispersed therein of at least two disparate particle sizes, one of said carbon particles having an average particle diameter of from about 300 to about 350 mu and the other particle having an average particle diameter of about 60 to about 100 mu, said carbon particles of different sizes being present in a weight ratio of from about 40:60 for to about 60:40, and the total amount of said carbon particles being from about 40% to about 65% by weight, and said fuel containing a stabilizing amount of a surfactant.

8. The composition of claim 7 wherein the carbon particles comprise a medium thermal black and a semi-reinforcing black and the weight ratio of said black is 50:50.

9. The composition of claim 8 wherein the fuel is JP-10 and the total amount of said carbon black is about 65% by weight.

10. The composition of claim 8 wherein the fuel is a 40:60 by volume ratio of JP-10 and RJ-5 and the total amount of carbon black is about 56% by weight.

* * * * *